United States Patent [19]

Gouyou-Beauchamps

[11] 3,971,344

[45] July 27, 1976

[54] SAFETY DEVICE FOR INSTANT WATER HEATER

[75] Inventor: Jacques Gouyou-Beauchamps, Ville d'Avray, France

[73] Assignee: Saunier Duval, Rueil Malmaison, France

[22] Filed: Jan. 8, 1975

[21] Appl. No.: 539,333

[30] Foreign Application Priority Data

Jan. 10, 1974 France ..... 74.00763
Feb. 25, 1974 France ..... 74.06265

[52] U.S. Cl. ..... 122/504; 431/75
[51] Int. Cl.[2] ..... F22B 37/42; F23N 5/02
[58] Field of Search ..... 122/448 R, 504; 126/351; 236/20 B, 33; 431/75; 251/58, 63.4

[56] References Cited

UNITED STATES PATENTS 2,312,479 3/1943 Ray ..... 236/21 B
2,412,235 12/1946 Denberg et al. ..... 236/33
3,738,352 6/1973 Reichmann ..... 126/351

FOREIGN PATENTS OR APPLICATIONS 1,509,085 12/1967 France ..... 431/75

*Primary Examiner*—Kenneth W. Sprague
*Attorney, Agent, or Firm*—Kenway & Jenney

[57] ABSTRACT

The safety device disclosed herein is adapted for use with low power gas burning water heaters which are unvented. In order to limit the duty cycle of the heater, a thermal mass having a preselected thermal inertia is heated from the burner through a probe of limited heat conductivity so that the temperature of the thermal mass rises relatively slowly during operation of the heater and cools relatively slowly in the intervals between operation. If the thermal mass reaches a predetermined threshold temperature, the heater is turned off or sharply throttled back so as to limit the emission of combustion products into the atmosphere.

10 Claims, 4 Drawing Figures

SAFETY DEVICE FOR INSTANT WATER HEATER

BACKGROUND OF THE INVENTION

This invention relates to a safety device for use with unvented, low power, gas burning water heaters and more particularly to a device which limits the duty cycle of the burner used with such a heater.

In certain areas, instantaneous gas water heaters not exceeding 125 millitherms per minute need not be connected to smoke ducts, provided that certain precautions required by law are strictly observed. These precautions typically require that the heater be installed in a room of at least a certain size, having adequate air vents above and below the heater. Under these circumstances, the combustion products released into the room's air are gradually evacuated through this normal room ventilation. Accidents can sometimes occur, however, if the rate at which air is renewed is too low. The risk of poisoning by combustion products is heightened, moreover, in the case of prolonged use of the water heater.

One proposed solution to this problem involves keeping a check on the air in the room in which the water heater is installed. A safety cut-off is typically actuated whenever the level of toxic gases becomes too high. While such systems are relatively uncomplicated and reliable when dealing with a well-known gas under constant conditions of use, e.g., a natural gas of fixed composition at a given pressure, they are difficult to adapt for use with so called "all gas" heaters that can use different fuels at various pressures.

It is therefore useful, since the toxicity of the air usually reaches a dangerous level only after a prolonged period of use of the water heater, to utilize a safety device whose operation is linked to the period of use, the heater's safety cut-off being activated when the heater has been used for too long of a time which might lead to a dangerous level of poisonous gas in the room.

Among the several objects of the present invention may be noted the provision of a safety device for a low power, unvented gas water heater; the provision of such a device which limits the duty cycle of such a heater; and the provision of such a device which is of relatively simple and inexpensive construction.

SUMMARY OF THE INVENTION

In accordance with one aspect of the present invention, the safety device operates by providing a so-called "thermal image" which is in effect an analogue of the manner in which combustion products build up in the atmosphere around an unvented water heater. The apparatus employs a thermal mass having a relatively large and essentially preselected thermal inertia. This mass is heated by a probe which extends into the combustion area of the hot water heater. The probe has a limited thermal conductivity so that the temperature of the thermal mass rises relatively slowly during periods of operation of the burner. Likewise, between periods of operation, the mass cools relatively slowly. Considering the analogue further, it can then be seen that the rising temperature of the thermal mass simulates the build up of combustion products in the atmosphere in the room around the heater, while the cooling of the mass simulates the gradual venting of those combustion products by the normal circulation of the air through the toom. Associated with the thermal mass is a temperature sensing device which acts when a predetermined temperature is reached and, at that point, operates to turn off or substantially throttle back the burner thereby limiting the generation of combustion products.

BRIEF DESCRIPTION OF THE DRAWINGS

Corresponding reference characters indicate corresponding parts throughout the several views of the drawings.

DETAILED DESCRIPTION OF THE PREFERED EMBODIMENTS

Figure 1:
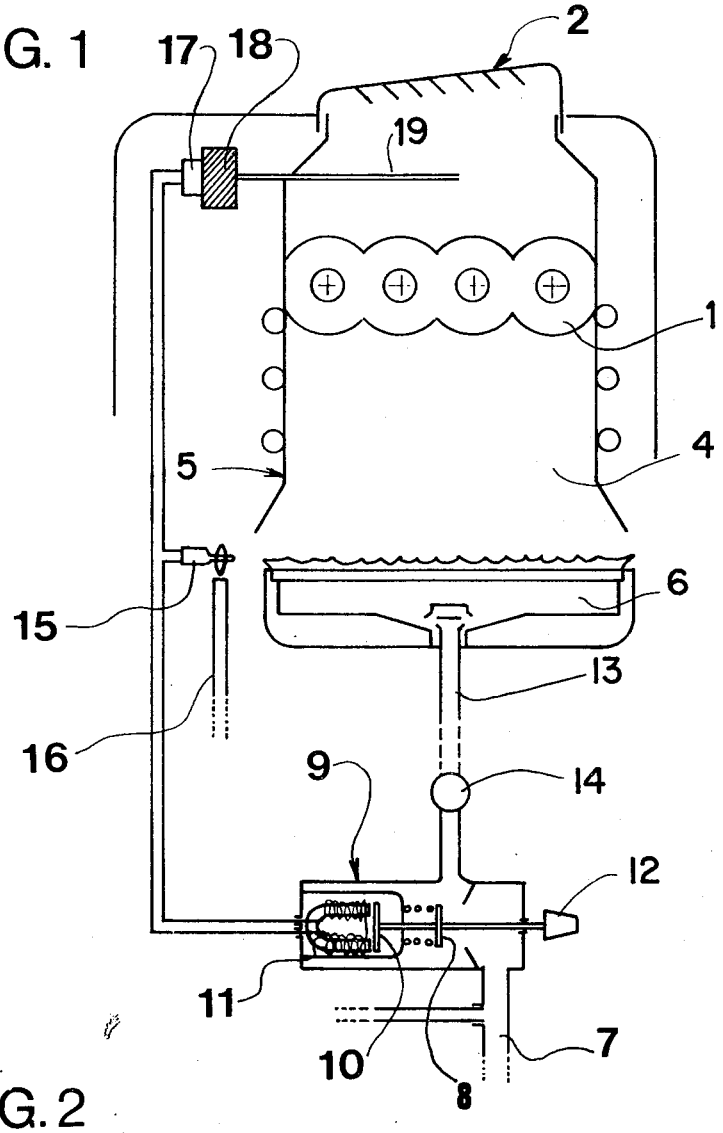
FIG. 1 is a schematic diagram of a low power gas burning hot water heater employing one embodiment of a safety device constructed in accordance with the present invention.

FIG. 1 shows a low-power gas water-heater fitted with a flanged heat exchanger block 1 capped by a vent or damper 2 in direct communication with the air of the room. The combustion chamber 4 is enclosed in a conventional manner by the skirt 5 of the heat exchanger placed above the burners 6. The arrival of the gas to the burners is conditioned by the opening of a safety valve 8 located in an enclosure 9. The armature 10 of an electromagnet 11 is linked with the valve 8 and a reset button 12. As is conventional, the valve 8 may be manually opened by the push button and held in open position, thus allowing the gas coming from the pipes 7 to reach the burners 6 by passing through a system of intake pipes 13. The intake pipes also pass through a control valve (indicated schematically at 14) which is operated in response to the demand upon the system, e.g., in response to the outlet water temperature or the drawing of water. The electromagnet 11 is linked both to a thermocouple switch 15 placed in the flame of the pilot 16 and to a fast acting thermoswitch 17, e.g., of the double-bladed kind. The thermocouple 15 and thermoswitch 17 are connected in series so that either can de-energize the electromagnet 11.

The thermoswitch 17 is attached to a thermal mass 18 which is itself connected to a thermal probe 19. The probe 19 is kept above the flanged block in the evacuation zone of the burned gases, and is made of a material having a relatively low thermal conductivity. The thermal mass 18 has a relatively high heat capacity providing a preselected thermal inertia. Further, it is insulated or shielded so as not to lose any of its heat by radiation and is located so that it is not heated because of the rest of the apparatus. In the embodiment of FIG. 1, the thermal mass 18 is located outside the heating element.

Figure 2:
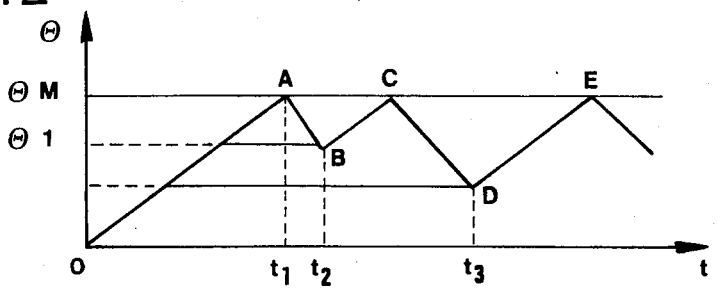
FIG. 2 is a graph illustrating the operation of the apparatus of FIG. 1 and particularly the temperature of the thermal mass during successive uses of the water heating apparatus.

The device works as follows:

When the apparatus is working, the probe 19 is subject to heating without restriction owing to the burned gases that vent from the flanged block 1. It is thus brought to a temperature close to 150°. Because of its low thermal conductivity, the probe 19 transmits its heat slowly but at a predetermined rate to the thermal mass 18 whose temperature will rise regularly with time during a period ($t_1$) that is rather long, as shown by the curve of FIG. 2. Because the thermal mass 18 is insulated and its temperature raised after a certain length of time, one can consider the ambient temperature as having essentially effect on the functioning of the device. After a period $t_1$, the thermal mass 18 reaches the maximum regulated temperature $\theta$M, at which point the thermoswitch 17 is immediately triggered, there being no delay once the rise in temperature has taken place. The current of the thermocouple safety device is cut off, the electromagnet 10 is de-energized and the valve 8 governing the intake of gas to the burners is closed, that is the burner is completely throttled. If the operator waits only a few moments for the temperature of the whole apparatus to drop, e.g., for the period from $t_1$ to $t_2$, he will be able to relight the burner after he actuates the button 12. However, because the probe 19 and the thermal mass is still at a relatively high temperature, the safety device will operate again after a relatively brief period of heating $t_2$ to $t_3$ with a rise to point C at the maximum temperature $\theta$M. The curves CD-DE illustrate the same process, but with a longer wait before starting the apparatus up again. Thus, if one waits a rather long time, long enough for an almost total cooling of the thermal mass 18, one can use the apparatus for as long as the control is set for. This works toward the goal of safety: after the thermoswitch has come into play, the apparatus must be rested long enough to produce a renewal of the air in the room. If one waits only a short time, the counterweight will not have cooled, but neither will the air have been renewed.

Figure 3:
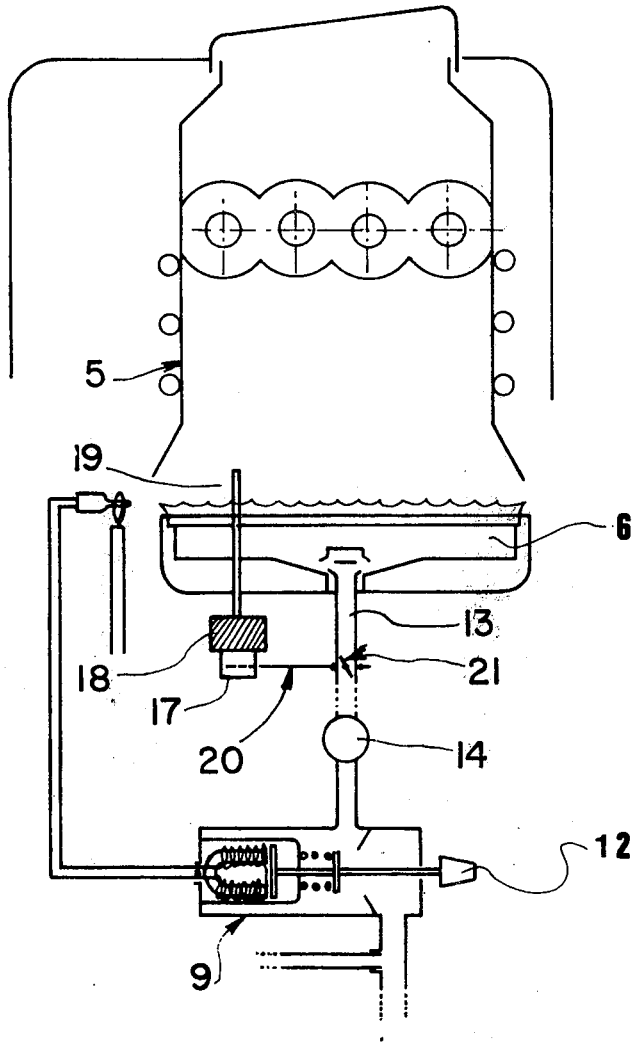
FIG. 3 is a schematic diagram of a water heater employing another embodiment of the safety device.

FIG. 3 illustrates a variant application: the probe 19 is placed inside the skirt 5 of the heating unit, and protrudes beyond the burners 6. The counterweight 18 to which it is connected is in a cold zone of the apparatus under the burners. The temperature-sensing element 17, e.g., a bi-metal actuator, by means of a rod 20 operates a small valve 21 which obstructs the pipe 13 through which gas is admitted to the burner. When the apparatus has been in operation so that the predetermined time for the thermal mass 18 to reach temperature $\theta$M has elapsed, the temperature-sensing element triggers the closing of the valve 21, which interrupts the flow of the gas thereby throttling the burner. It should be noted that the closing of this small valve 21 can be total or partial; that is, it is enough to have a very appreciable reduction in the flow of gas to the burner in order to obtain a reduction in the emissions of burned gas in the area. The significance of this application is that it frees the operator from having to reactivate the safety button 12 in order to start the apparatus up again.

The invention is applicable as well to any combination of the situations represented in the Figures: that is, whatever the position of the probe 19, the fast cut-off temperature-sensing device controls directly or indirectly either the triggering of the safety device 9 (as shown in the case of FIG. 1), the closing of a device that blocks the admission of gas 21 (as is the case in FIG. 3), or finally the direct closing of the obstructing element 14 normally meant to control the admission of gas in case of water being drawn.

Figure 4:
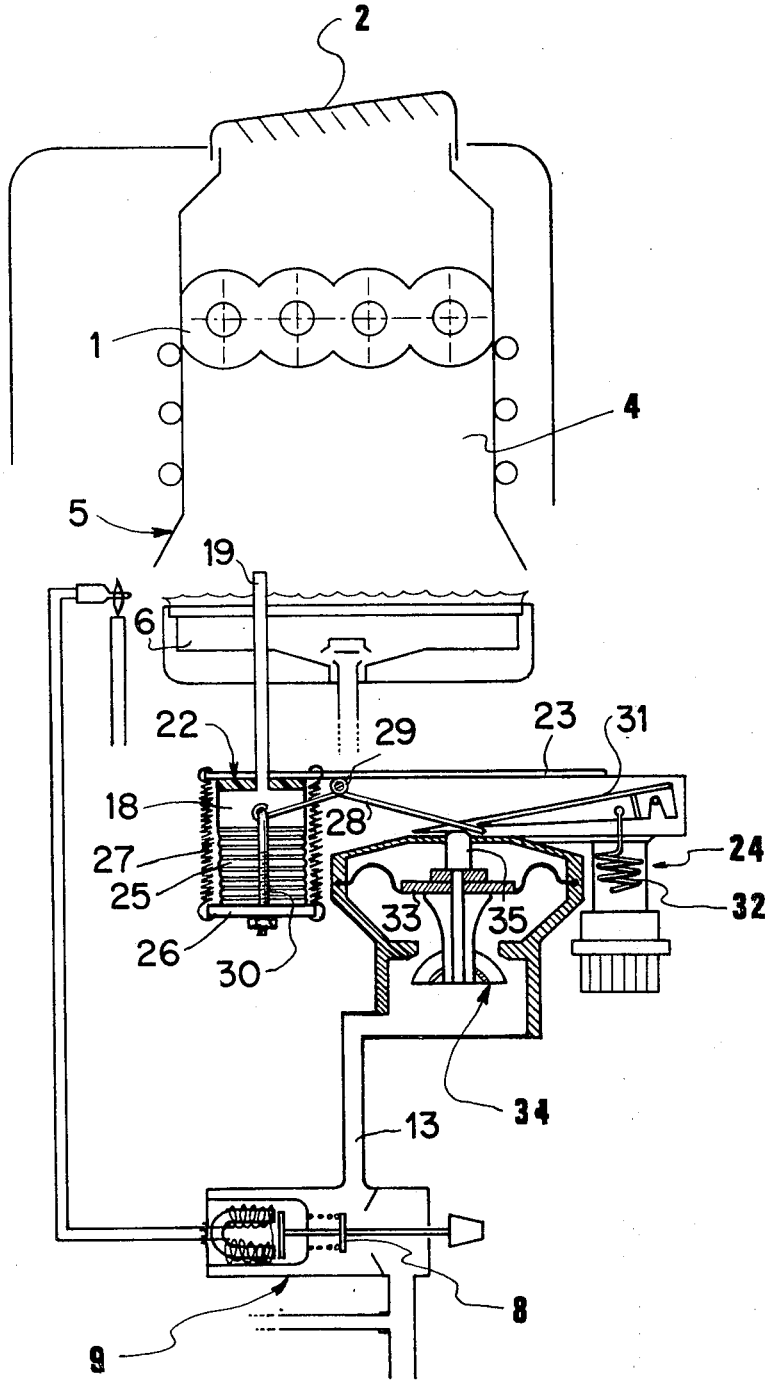
FIG. 4 illustrates a water heater employing a still further embodiment of the invention.

FIG. 4 shows the adaptation of the safety system described above to the gas regulating mechanism itself that is usually mounted on top of the apparatus.

The low-power gas water-heater consists of a flanged heat exchanger block 1 capped by a damper 2 in direct communication with the air of the room. The combustion chamber 4 is enclosed, as is known, by the skirt 5 of the heating exchanger placed above the burners 6. The flow of gas to the burners is conditioned upon the opening of the intake valve 8 which is part of a thermoelectric safety device 9 to prevent the pilot from going out. The temperature-sensing device is made up of a probe 19 that protrudes beyond the burners 6 inside the skirt 5 of the heating unit.

The probe 19 is connected to a thermal mass 18 placed under the burners and is located by an insulating joint 22 on a supporting plate 23. This plate 23 is itself attached to a gas regulating device 24 mounted over the pipe 13 that admits gas to the burner. The gas regulating device is essentially convential, comprising a diaphragm 33 controlling a gas-regulating valve 34 through a rod 35. The diaphragm and the valve are biased by a regulating spring operating on the diaphragm through a lever 31 which bears on rod 35. A bellows 25 filled with an expandable fluid is held in close thermal contact with the thermal mass 18, by means of a tray 26 that is kept biased against the thermal mass through the use of springs 27 attached to the plate 23. An arm 28 pivoting around a horizontal axis 29 is driven by a rod 30 attached to the plate 23, the rod being toward the viewer from the bellows 25 as seen in FIG. 4. The end of the arm 28 passes through an aperture in the lever 31.

The functioning of this improvement is as follows:

After a predetermined period of continued use, the probe 19 will have brought the thermal mass 18 to such a temperature as to cause the fluid contained in the bellows 25 to expand, so that the bellows tends to separate the tray 27 from the plate 23 in opposition to the springs 27. This downward movement of the tray 25 is transmitted to the pivoting arm 28 which swings around its axle 29 and whose tip then lifts the lever 31 that frees the rod 35. Since the movement of closing the gas regulating valve 34 is no longer countered by the rod 35 that was holding the membrane 33 in position, the valve 34 takes a high position, which causes a very appreciable reduction in the flow of gas to the burner, and consequently a reduction in the emissions of burned gases to the atmosphere.

What is claimed is:

1. A safety device for a gas water heater of the type in which combustion products from a gas burner are vented into the room in which the heater is installed, said device comprising:

a thermal mass having a preselected thermal capacity, said mass being positioned away from the heating zone of said heater:

a probe of preselected thermal conductivity extending from said mass into the heating zone of said heater, thereby to cause the temperature of said mass to increase at an essentially predetermined rate during operation of said burner; the cooling of said mass occuring at an essentially predetermined rate between operations of said burner;

selectively operable throttling means for said burner; and a temperature sensing means which is responsive to the temperature of said mass and which is interconnected with said throttling means for substantially throttling said burner when the temperature of said mass reaches a preselected threshold temperature.

2. A safety device as set forth in claim 1 wherein said sensing means is a thermoswitch contacting said thermal mass.

3. A safety device as set forth in claim 2 wherein said throttling means is an electrically operated safety valve.

4. A safety device as set forth in claim 3 wherein said burner is provided with a pilot light and a thermocouple safety switching device for de-energizing said safety valve when said pilot light is extinguished.

5. A safety device as set forth in claim 4 wherein said thermoswitch and said thermocouple safety switching device are connected in series with said valve.

6. A safety device as set forth in claim 1 wherein said sensing means is a thermo-mechanical device, wherein said throttling means is a valve in the gas supply to said burner, and wherein said sensing means directly operates said valve.

7. A safety device as set forth in claim 6 wherein said valve completely shuts off the gas to said burner when said mass reaches said threshold temperature.

8. A safety device as set forth in claim 6 wherein said valve operates to substantially reduce the flow of gas to said burner to a preselected, relatively low level when said thermal mass reaches said preselected threshold temperature.

9. A safety device as set forth in claim 1 wherein said burner is provided with a diaphragm operated control valve, the diaphragm being biased by spring means and wherein said sensing means operates to alter the bias.

10. A safety device for a gas water heater of the type in which combustion products from a gas burner are vented into the room in which the heater is installed, said burner being provided with a diaphragm operated control valve, the diaphragm being biased by spring means through a lever, said safety device comprising:

a thermal mass having a preselected thermal capacity, said mass being positioned away from the heating zone of said heater;

a probe of preselected thermal conductivity extending from said mass into the heating zone of said heater, thereby to cause the temperature of said mass to increase at an essentially predetermined rate during operation of said burner; the cooling of said mass occurring at an essentially predetermined rate between operations of said burner;

selectively operable throttling means for said burner; and a temperature sensing means comprising a temperature sensitive expanding device which is responsive to the temperature of said mass and which is interconnected with said throttling means to lift the biasing lever from the diaphragm as the thermal mass heats for substantially throttling said burner when the temperature of said mass reaches a preselected threshold temperature.

* * * * *